US008556377B2

(12) United States Patent
Takeda et al.

(10) Patent No.: US 8,556,377 B2
(45) Date of Patent: Oct. 15, 2013

(54) IMAGE RECORDING APPARATUS, CONTROLLER USED FOR THE IMAGE RECORDING APPARATUS AND STORAGE MEDIUM STORING PROGRAM FOR THE CONTROLLER

(75) Inventors: Kengo Takeda, Inazawa (JP); Shigeki Kato, Toyoake (JP); Naokatsu Osawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 255 days.

(21) Appl. No.: 13/076,091

(22) Filed: Mar. 30, 2011

(65) Prior Publication Data

US 2011/0242152 A1 Oct. 6, 2011

(30) Foreign Application Priority Data

Mar. 31, 2010 (JP) ..... 2010-083960

(51) Int. Cl.
*B41J 2/165* (2006.01)

(52) U.S. Cl.
USPC ..... 347/33; 347/22; 347/23

(58) Field of Classification Search
USPC ..... 347/33, 22–23
See application file for complete search history.

(56) References Cited

U.S. PATENT DOCUMENTS

| | | | | |
|---|---|---|---|---|
| 5,225,853 | A | 7/1993 | Kobayashi et al. | |
| 7,588,309 | B2 * | 9/2009 | Nakashima | 347/22 |
| 2004/0046852 | A1 * | 3/2004 | Pham et al. | 347/104 |
| 2006/0028660 | A1 | 2/2006 | Lim | |
| 2007/0209539 | A1 | 9/2007 | Mori | |
| 2007/0236535 | A1 | 10/2007 | Baker et al. | |
| 2008/0158293 | A1 * | 7/2008 | Hung | 347/33 |
| 2009/0244245 | A1 | 10/2009 | Mitsuhashi et al. | |
| 2011/0261130 | A1 | 10/2011 | Hirai et al. | |

FOREIGN PATENT DOCUMENTS

| | | | |
|---|---|---|---|
| EP | 1160090 | A1 | 12/2001 |
| EP | 1695837 | A1 | 8/2006 |
| JP | H11-192694 | A | 7/1999 |
| JP | 2000-127362 | A | 5/2000 |
| JP | 2005-187160 | A | 7/2005 |
| JP | 2006-198988 | A | 8/2006 |
| JP | 2006-206279 | A | 8/2006 |

(Continued)

OTHER PUBLICATIONS

Japan Patent Office, Decision to Grant a Patent for Japanese Patent Application No. 2010-083960 (counterpart to above-captioned patent application), dispatched Mar. 6, 2012.

(Continued)

*Primary Examiner* — Jason Uhlenhake
(74) *Attorney, Agent, or Firm* — Baker Botts L.L.P.

(57) ABSTRACT

An image recording apparatus includes: a recording portion; a conveying member having a surface opposed to the recording portion and which conveys the recording medium in a conveying direction; a wiper having an end portion which is contactable with the surface of the conveying member and which removes a foreign matter on the surface of the conveying member; and a wiping operation executing portion which executes a wiping operation in which at least one of the wiper and the conveying member is driven such that, after the end portion of the wiper distant from the surface of the conveying member comes into contact with a clean area of the surface of the conveying member, the end portion of the wiper reaches outside of the clean area.

10 Claims, 8 Drawing Sheets

(56) References Cited

FOREIGN PATENT DOCUMENTS

| | | | |
|---|---|---|---|
| JP | 2006-264893 | A | 10/2006 |
| JP | 2007-076863 | A | 3/2007 |
| JP | 2008-012846 | A | 1/2008 |
| JP | 2008-018566 | A | 1/2008 |

OTHER PUBLICATIONS

European Patent Office, extended European Search Report for European Patent Application No. 11160413.8 (counterpart to above-captioned patent application), dated Apr. 23, 2012.

* cited by examiner

IMAGE RECORDING APPARATUS, CONTROLLER USED FOR THE IMAGE RECORDING APPARATUS AND STORAGE MEDIUM STORING PROGRAM FOR THE CONTROLLER

CROSS REFERENCE TO RELATED APPLICATION

The present application claims priority from Japanese Patent Application No. 2010-083960, which was filed on Mar. 31, 2010, the disclosure of which is herein incorporated by reference in its entirety.

BACKGROUND OF THE INVENTION

1. Field of the Invention

The present invention relates to an image recording apparatus which records an image on a recording medium, a controller which is used for the image recording apparatus and a storage medium storing a program.

2. Discussion of Related Art

There is known a technique in which, in an image recording apparatus such as a printer, a wiper removes a foreign matter including paper dust that is adhered to a surface of a conveying member such as a conveyor belt. For example, in some inkjet recording apparatus, a preliminary (preparatory) ejection is performed toward the surface of the conveying member. The preliminary ejection is an ejecting operation that is different from an ejecting operation for an image recording and that is performed in order to reduce or prevent viscosity of ink in the vicinity of a nozzle of a recording head. In this case, because ink is adhered to the surface of the conveying member due to the preliminary ejection, it is necessary to remove the ink by a wiper. In order to maintain a foreign-matter removing performance of the wiper (a wiping performance), after the image recording based on a recording command is finished, an end of the wiper is cleaned by an absorber and so forth.

SUMMARY OF THE INVENTION

However, even if the end of the wiper is cleaned, the foreign matter such as paper dust is adhered to the surface of the conveying member while the wiper is distant from the surface of the conveying member, and when the end of the wiper contacts the surface of the conveying member, it is likely that the foreign matter lies between the end of the wiper and the surface of the conveying member. In this case, a clearance is made between the end of the wiper and the surface of the conveying member, and the foreign matter that should be removed by the wiper slips through the clearance, so that the wiping performance may be reduced.

It is therefore an object of the present invention to provide a recording apparatus, a controller and a storage medium storing a program to be able to effectively restrain the reduction of the wiping performance.

In order to achieve the above-mentioned object, according to the present invention, there is provided an image recording apparatus comprising: a recording portion configured to record an image on a recording medium; a conveying member which has a surface opposed to the recording portion and which is configured to convey the recording medium in a conveying direction by a movement of the surface of the conveying member in the conveying direction with the recording medium supported by the surface thereof; a wiper which has an end portion contactable with the surface of the conveying member and which is configured to remove a foreign matter on the surface of the conveying member by a relative movement of the wiper to the surface of the conveying member with the end portion of the wiper and the surface of the conveying member in contact with each other; and a wiping operation executing portion configured to execute a wiping operation in which at least one of the wiper and the conveying member is driven such that, after the end portion of the wiper distant from the surface of the conveying member comes into contact with a clean area, the end portion of the wiper reaches outside of the clean area, wherein the clean are is a part of the surface of the conveying member and has a smaller amount of the foreign matter adhering thereto compared to the other part of the surface.

BRIEF DESCRIPTION OF THE DRAWINGS

The above and optional objects, features, and advantages of the present invention will be better understood by reading the following detailed description of the embodiments of the invention when considered in conjunction with the accompanying drawings, in which.

DETAILED DESCRIPTION OF THE EMBODIMENTS

Figure 1:
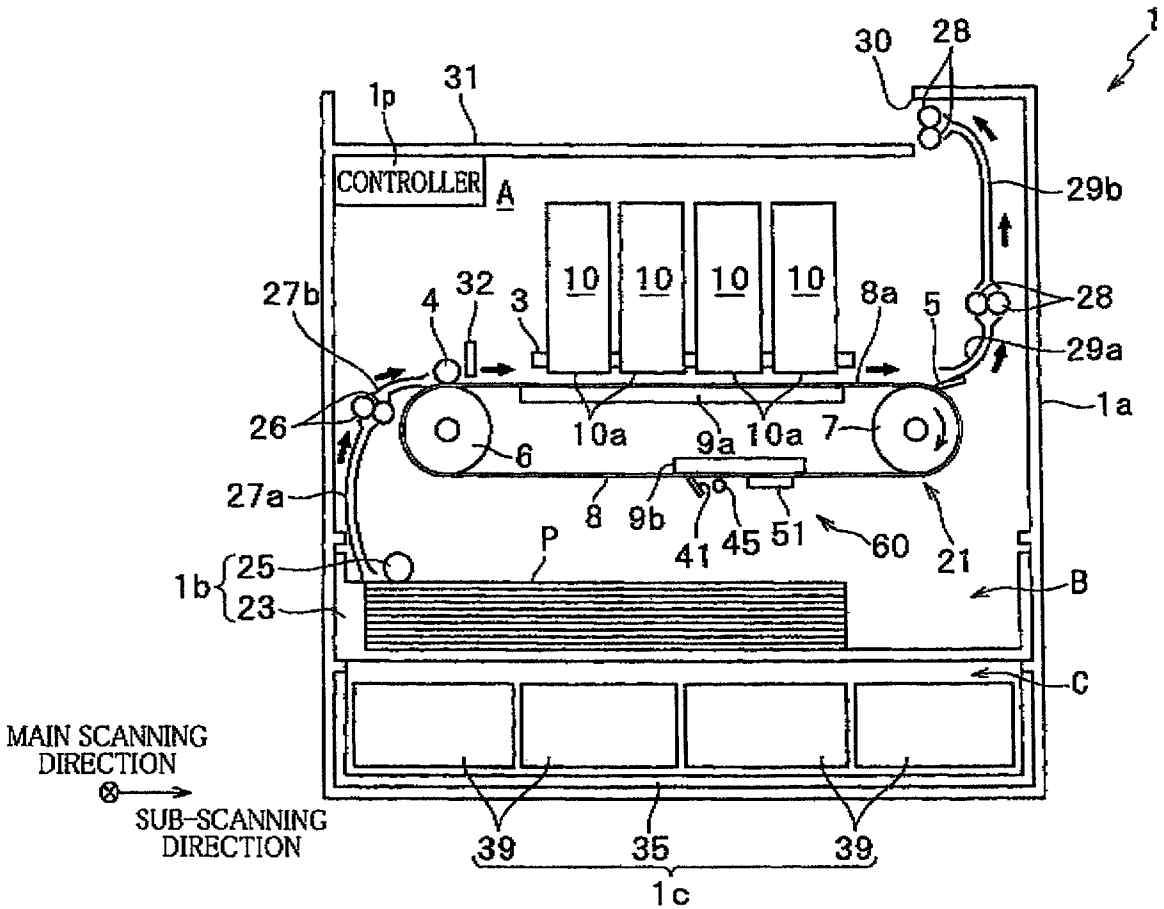
FIG. 1 is a side view schematically showing an internal structure of an inkjet printer as a first embodiment of an image recording apparatus to which the present invention is applied.

Hereinafter, there will be described embodiments of the present invention with reference to the drawings.

There will be described an overall configuration of an inkjet printer 1 as a first embodiment of an image recording apparatus to which the present invention is applied with reference to FIG. 1.

The inkjet printer 1 includes a casing 1*a* having a rectangular parallelepiped shape. In an upper portion of a top panel of the casing 1*a*, there is provided a sheet-discharge portion 31. An internal space of the casing 1*a* is divided into spaces A, B, and C in an order from a top. In the spaces A and B, there is formed a sheet convey path that is connected to the sheet-discharge portion 31. In the space C, there are disposed four cartridges 39 as ink-supply sources to four inkjet heads 10, an example of a recording portion.

The four inkjet heads 10, a conveying unit 21 which conveys a recording sheet P, an example of a recording medium, a maintenance unit 60 which is disposed below the conveying unit 21, a guide unit which guides the recording sheet P and so on are located in the space A. In an upper portion of the space A, there is located a controller 1*p* which manages (directs) overall operations of the printer 1 by controlling operations of respective portions of the printer 1.

The controller 1*p* controls, based on image data supplied from an external device, recording operations including a conveying operation of the recording sheet P by the respective portions of the printer 1 and an ink-ejecting operation which is synchronized with the conveying operation of the recording sheet P. The controller 1*p* also controls, based on a wiping command, drives of the conveying unit 21 and the maintenance unit 60 so as to perform a maintenance operation. In the present embodiment, the maintenance operation means a series of operations including a wiping operation in which foreign matters (such as ink, paper dust and so forth) on a surface 8*a* of a conveyor belt 8 (an example of a conveying member) are removed from the same 8*a*. A specified content of the maintenance operation will be described in detail later.

The conveying unit 21 includes a pair of belt rollers 6, 7, an endless conveyor belt 8 that is wound on the rollers 6,7, a nip roller 4 and a separate plate 5 that are respectively located outside of the conveyor belt 8, a platen 9*a* that is located inside an area surrounded by the conveyor belt 8, and so forth. The belt roller 7 is a drive roller that is driven by a conveying motor 121 (shown in FIG. 7) and rotated in a clockwise direction in FIG. 1. The conveyor belt 8 is circulated in a thick arrow direction in FIG. 1 with the rotation of the belt roller 7. The belt roller 6 is a driven roller that is rotated in the clockwise direction in FIG. 1 with the circulation of the conveyor belt 8. The nip roller 4 is opposed to the belt roller 6 and presses the recording sheet P supplied from an upstream portion of the sheet convey path in a conveying direction against a surface 8*a* (an outer circumferential surface) of the conveyor belt 8. The recording sheet P is then conveyed toward the belt roller 7 with the circulation of the conveyor belt 8 while the recording sheet P is kept on or supported by the surface 8*a*. The separate plate 5 is opposed to the belt roller 7 and separates the recording sheet P from the surface 8*a* and guides to a downstream portion of the sheet convey path in the conveying direction. The platen 9*a* is located on the opposite side of the conveyor belt 8 from the four inkjet beads 10 and supports an upper loop-shaped portion of the conveyor belt 8 from inside.

The maintenance unit 60 includes a main wiper 41 (an example of a wiper), a sub wiper 51 (an example of a sub-wiper), a wiper cleaner 45, and so on. Respective portions of the maintenance unit 60 are opposed to the surface 8*a* of a lower loop-shaped portion of the conveyor belt 8. Inside the area surrounded by the conveyor belt 8 and at a position in an opposed relationship with the wipers 41, 51 relative to the conveyor belt 8, there is disposed a platen 9*b* which supports the lower loop-shaped portion of the conveyor belt 8 from the inside thereof. When the wipers 41, 51 respectively remove the foreign matters, the platen 9*b* prevents the conveyor belt 8 from being bent due to a pressure force by the wipers 41, 51. A more specified configuration of the maintenance unit 60 will be described later with reference to FIGS. 5 and 6.

Each of the four inkjet heads 10 is a line-type head having a generally rectangular parallelepiped shape extending in a main scanning direction. A lower surface of each inkjet head 10 is an ejection surface 10*a* in which a plurality of nozzles or ejection openings 14*a* (shown in FIGS. 3 and 4) are formed. In a recording (an image forming) operation, four colors of inks (black, magenta, cyan, and yellow) are respectively ejected through the corresponding ejection surfaces 10*a* of the four inkjet heads 10. The four inkjet heads 10 are arranged to be adjacent to each other at predetermined distances in a sub-scanning direction and are supported by the casing 1*a* through a head holder 3. The head holder 3 holds the four inkjet heads 10 such that the ejection surface 10*a* of each inkjet head 10 is opposed to the surface 8*a* of the upper loop-shaped portion of the conveyor belt 8 and a desired clearance suitable for the recording operation is made between the ejection surface 10*a* of each head 10 and the surface 8*a* of the same 8. A more specified configuration of each inkjet head 10 will be described later with reference to FIGS. 2 through 4.

The guide unit includes an upstream guide portion and a downstream guide portion that are located on opposite sides of the conveying unit 21 in the conveying direction. The upstream guide portion includes two guides 27*a*, 27*b* and a pair of feed rollers 26. The upstream guide portion connects a sheet-supply unit 1*b* (described later) with the conveying unit 21. The downstream guide portion includes two guides 29; 29*b* and two pairs of feed rollers 28. The downstream guide portion connects the conveying unit 21 and the sheet-discharge portion 31.

In the space B, the sheet-supply unit 1*b* is located so as to be detachably attached to the casing 1*a*. The sheet-supply unit 1*b* includes a sheet-supply tray 23 and a sheet-supply roller 25. The sheet-supply tray 23 is a box-like member opening upward and can accommodate the recording sheets P with a plurality of sizes. The sheet-supply roller 25 supplies an uppermost one of the recording sheets P stored in the sheet-supply tray 23 to the upstream guide portion.

As mentioned before, in the spaces A and B, the sheet convey path is formed so as to extend from the sheet-supply unit 1*b* to the sheet-discharge portion 31 via the conveying unit 21. The controller 1*p* drives, based on a recording command received from the external device, a sheet-supply motor 125 (shown in FIG. 7) for the sheet-supply roller 25, a feed motor 127 (shown in FIG. 7) for the respective feed rollers 26, 28 of the upstream, downstream guide portions, the conveying motor 121 (shown in FIG. 7) and so forth. The recording sheet P supplied from the sheet-supply tray 23 is fed to the conveying unit 21 by the feed rollers 26. When the recording sheet P passes right below the four inkjet heads 10 in the sub-scanning direction, the inkjet heads 10 respectively eject the corresponding colors of inks toward the recording sheet P in order, so that a color image is formed on the recording sheet P. An ink ejection from each inkjet head 10 is performed based on a detection signal from a sheet sensor 32. The recording sheet P on which the image is formed is then separated by the separate plate 5 and fed upward by the two pairs of feed rollers 28. The recording sheet P is discharged to the sheet-discharge portion 31 through an opening 30 that is formed in the upper portion of the casing 31.

In the present embodiment, the sub-scanning direction is a direction in parallel with the conveying direction in which the recording sheet P is conveyed by the conveying unit 21, and the main scanning direction is a direction in parallel with a horizontal surface and perpendicular to the sub-scanning direction.

In the space C, a cartridge unit 1*c* is located so as to be detachably attached to the casing 1*a*. The cartridge unit 1*c* includes a tray 35 and four cartridges 39 that are arranged to be adjacent to each other in the tray 35. The four colors of inks are respectively supplied from the four cartridges 39 to the corresponding inkjet heads 10 via tubes (not shown).

The configuration of the inkjet heads 10 will be described in detail with reference to FIGS. 2 through 4. In FIG. 3, a plurality of pressure chambers 16 and a plurality of apertures 15 are indicated by solid lines, though the pressure chambers 16 and the apertures 15 should be shown by broken lines because these are located below a plurality of actuator units 17.

The inkjet head 10 includes a reservoir unit (not shown) and a channel unit 12 which are stacked on each other in a vertical direction, eight actuator units 17 (shown in FIG. 2) which are fixed to an upper surface 12*x* of the channel unit 12, a flexible printer circuit (FPC) 19 (shown in FIG. 4) which is connected to the respective actuator units 17, and so on. The reservoir unit has a channel that includes a reservoir for temporarily storing ink supplied from the cartridges 39 (shown in FIG. 1). In the channel unit 12, there are formed channels extending from a plurality of openings 12*y* (shown in FIG. 2) formed on the upper surface 12*x* to the nozzles 14*a* formed on a lower surface (the ejection surface 10*a*). The actuator unit 17 includes a piezoelectric actuator for each nozzle 14*a*.

A lower surface of the reservoir unit has a concave portion and a convex portion. The convex portion of the reservoir unit is adhered to an area of the upper surface 12*x* of the channel unit 12 in which the actuator units 17 are not located. On a (lower) surface of the convex portion, there are formed a plurality of openings that are connected to the reservoir and are opposed to the corresponding openings 12*y* of the channel unit 12. Accordingly, the reservoir and a plurality of individual channels 14 are in communication with each other through the openings of the reservoir unit. The concave portion of the reservoir unit is opposed to the upper surface 12*x* of the channel unit 12, upper surfaces of the actuator units 17 and an upper surface of the FPC 19 with a slight clearance being made therebetween.

Figure 3:
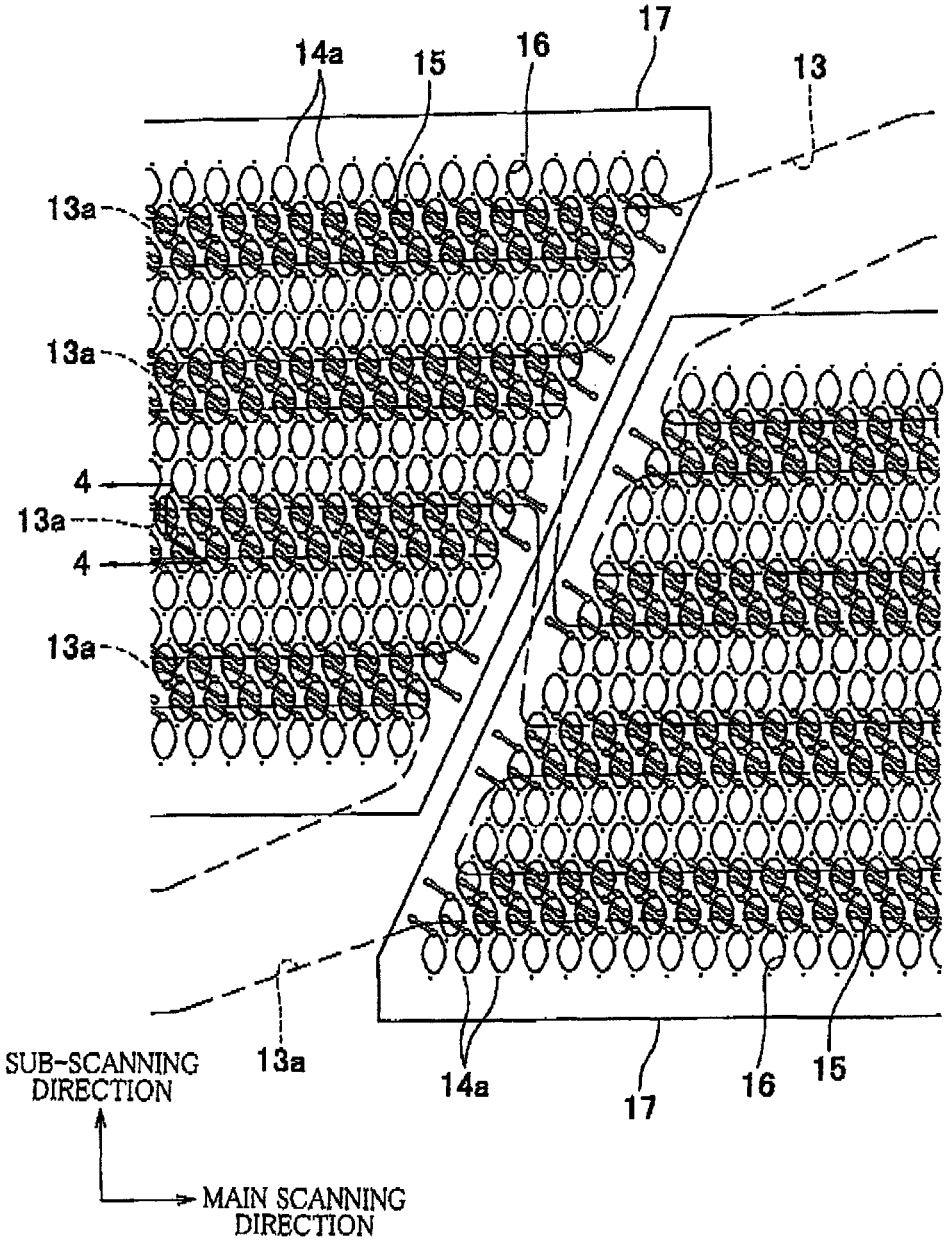
FIG. 3 is an enlarged view showing an area 3 enclosed with a one-dot chain line in FIG. 2.
Figure 4:
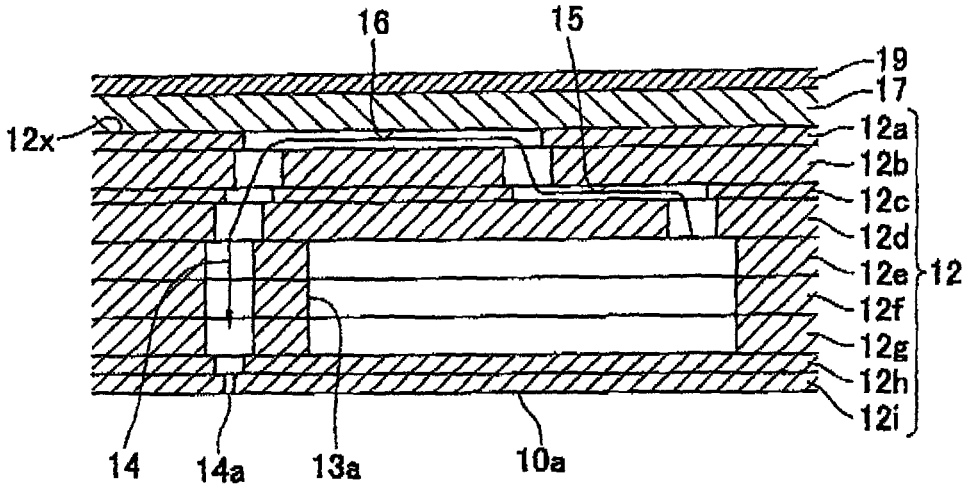
FIG. 4 is a cross-sectional view taken along a line 4-4 in FIG. 3.

As shown in FIG. 4, the channel unit 12 has a laminar structure which includes nine rectangular metallic plates 12*a*, 12*b*, 12*c*, 12*d*, 12*e*, 12*f*, 12*g*, 12*h*, 12*i* having the generally same size that are stacked on, and adhered to, each other. As shown in FIGS. 2, 3 and 4, a channel formed in the channel unit 12 includes a manifold channel 13 having the opening 12*y* at one of opposite ends thereof, a sub-manifold channel 13*a* that is branched from the manifold channel 13, and the individual channel 14 extending from an outlet of the sub-manifold channel 13*a* to each nozzle 14*a* through the pressure chamber 16. As shown in FIG. 4, the individual channel is formed for each nozzle 14*a* and includes an aperture 15 functioning as a throttle valve for adjusting a channel resistance. In adhesion areas of the upper surface 12*x* of the channel unit 12 to which the actuator units 17 are respectively adhered, openings are arranged like a matrix. Each of the openings has a generally rhombic shape as seen in the vertical direction and the pressure chambers 16 are exposed through the openings. In areas of the lower surface (the ejection surface 10*a*) corresponding to the adhesion areas, the nozzles 14*a* are arranged like a matrix in the same manner as the arrangement of the pressure chambers 16.

Figure 2:
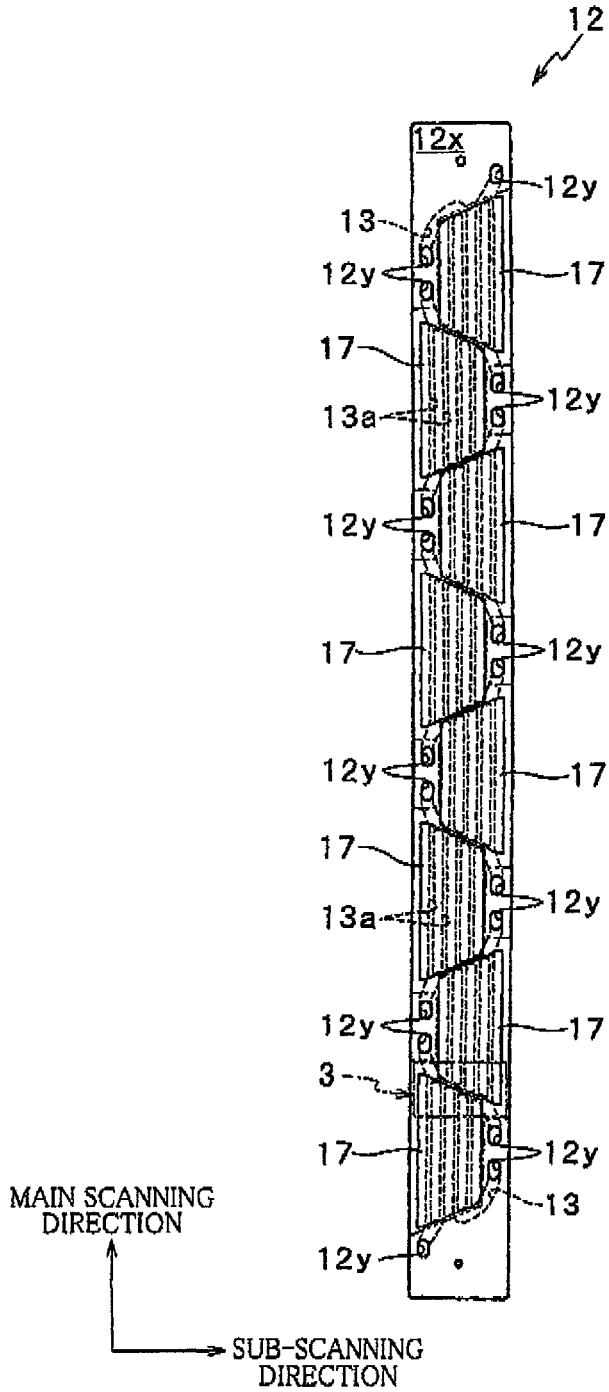
FIG. 2 is a plan view of a passage unit and an actuator unit of an inkjet head of the printer.

As shown in FIG. 2, the actuator units 17, each of which has a trapezoidal shape in its plan view, are arranged in two rows and in a zigzag or a staggered manner on the upper surface 12*x* of the channel unit 12. As shown in FIG. 3, a multiplicity of openings of the pressure chambers 16, which are formed in the adhesion areas to which the actuator units 17 are adhered, are covered by the actuator units 17. The actuator unit 17 includes a plurality of piezoelectric layers that extend over the multiplicity of the pressure chambers 16 and electrodes between which the piezoelectric layers are interposed in a direction of thickness of the actuator unit 17. The electrodes consist of an individual electrode disposed for each pressure chamber 16 and a common electrode that is in common with the multiplicity of the pressure chambers 16. The individual electrode is located on an upper surface of an uppermost one of the piezoelectric layers that are stacked on each other.

The FPC 19 has wires corresponding to the respective electrodes of the actuator units 17, and a driver IC (not shown) is mounted on a middle portion of each wire of the FPC 19. One end portion of (each wire of) the FPC 19 is connected to the corresponding actuator units 17, and the other end portion thereof is connected to a control board of the inkjet heads 10 (that is located above the reservoir unit, not shown). The FPC 19, under a control by the controller 1*p* (shown in FIG. 1), transmits various drive signals that are supplied from the control board to the driver IC and signals that are produced in the drive IC to the actuator units 17.

Figure 5:
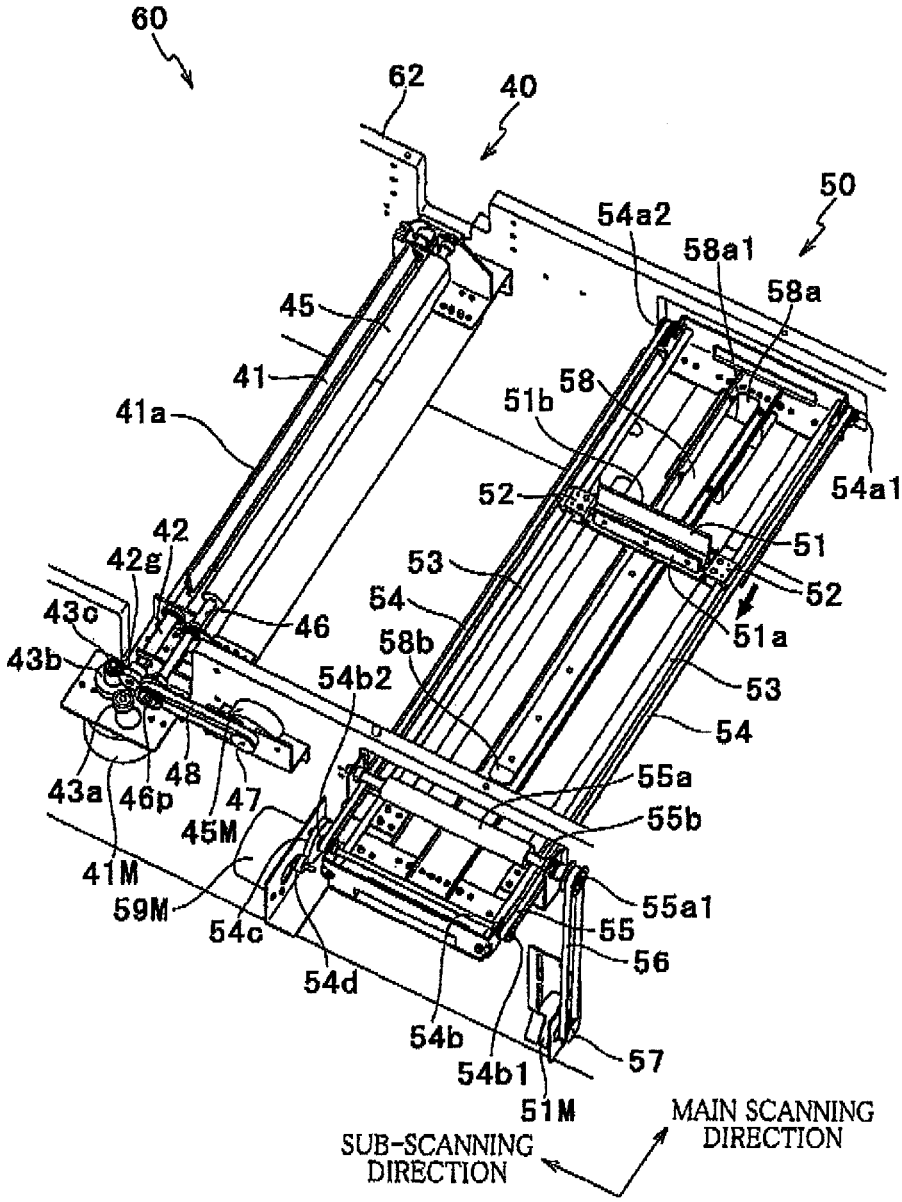
FIG. 5 is a perspective view showing a maintenance unit of the printer.

The configuration of the maintenance unit 60 will be described with reference to FIGS. 5 and 6. As shown in FIG. 5, the maintenance unit 60 includes a main wiping mechanism 40 and a sub-wiping mechanism 50.

The main wiping mechanism 40 includes the main wiper 41 and the wiper cleaner 45.

The main wiper 41 is a plate-like member which is made of an elastic material such as a rubber and extends in the main scanning direction. A base end (a lower end) of the main wiper 41 is fixed to a circumferential surface of a shaft 42. The shaft 42 extends in the main scanning direction and is supported by a frame 62 so as to be rotatable with the main wiper 41 about an axis extending in the main scanning direction. The frame 62 is fixed to the casing 1*a* (shown in FIG. 1). The main wiping mechanism 40 also includes, as component members for a rotation of the shaft 42, a gear 43*a* which is fixed to an output shaft of a motor 41M, a gear 43*b* which meshes with the gear 43*a*, and a worm gear 43*c* which is rotated with a rotation of the gear 43*b*. A worm wheel 42*g* which meshes with a circumferential surface of the worm gear 43*c* is attached to one of opposite end portions of the shaft 42 in the main scanning direction. When the gears 43*a*, 43*b*, 43*c* are rotated by a drive of the motor 41M, the worm wheel 42*g* is rotated. Accordingly, the shaft 42 is rotated about the axis extending in the main scanning direction, so that an inclination angle of the main wiper 41 relative to the horizontal surface is changed.

The controller 1*p* controls the inclination angle of the main wiper 41 such that, during the wiping operation, an (free) end 41*a* (an example of an end portion of the wiper) of the main wiper 41 is in contact with the surface 8*a* of the conveyor belt 8 in a state in which the vicinity of the end 41*a* of the same 41 is bent and, during a time except during the wiping operation, the end 418 of the same 41 is distant from the surface 8*a* of the conveyor belt 8. The controller 1*p* also controls the inclination angle of the main wiper 41 during a time except during a wiper cleaning operation (described later) such that the end 41*a* of the main wiper 41 is distant from the wiper cleaner 45.

The main wiper 41 has a length in the main scanning direction that is slightly longer than a width (a dimension in the main scanning direction) of the conveyor belt 8 so as to extend over the entire width of the conveyor belt 8 (and such that a center of the main wiper 41 in the main scanning direction coincides with a center of the conveyor belt 8 in a widthwise direction and the main wiper 41 extends in the main scanning direction from opposite side portions of the conveyor belt 8 in the widthwise direction as seen in the vertical direction). Therefore, the end 41*a* of the main wiper 41 is in contact with the conveyor belt 8 over the entire width of the same 8 during the wiping operation.

The wiper cleaner 45 is used for the wiper cleaning operation and is made of an absorber such as a sponge. The wiper cleaner 45 has a cylindrical shape extending in the main scanning direction and is rotatably supported on a shaft 46. The shaft 46 extends in the main scanning direction and is supported by the frame 62 so as to be rotatable with the wiper cleaner 45 about an axis in the main scanning direction. The main wiping mechanism 40 also includes, as component members for a rotation of the shaft 46, a pulley 47 which is fixed to an output shaft of a motor 45M, a pulley 46*p* which is fixed to one of opposite end portions of the shaft 46 in the main scanning direction, and a belt 48 which is wound on the pulleys 46*p*, 47. When the pulley 47 is rotated by a drive of the motor 45M, the belt 48 is circulated, and the pulley 46*p* is rotated with the circulation of the belt 48, so that the shaft 46 is rotated with the wiper cleaner 45 about the axis in the main scanning direction.

The sub-wiping mechanism 50 includes a sub-wiper 51 and a sub-wiper cleaner 55*a*.

The sub-wiper 51 is used for a pre-cleaning operation that will be described later and is a plate-like member which is made of an elastic material such as a rubber and extends in the sub-scanning direction. A base end (a lower end) of the sub-wiper 51 is fixed to a wiper supporter 51*a*. The wiper supporter 51*a* extends in the sub-scanning direction and is supported by the frame 62 so as to be pivotable with the sub-wiper 51 about an axis extending in the sub-scanning direction and movable in the main scanning direction. A pair of sliders 52 are attached to opposite end portions of the wiper supporter 51*a* in the sub-scanning direction. The wiper supporter 51*a* is supported by the pair of sliders 52 so as to be pivotable about an axis extending in the sub-scanning direction. The sub-wiper 51 and the wiper supporter 51*a* are biased in a clockwise direction in FIG. 6A by a biasing member (not shown) such as a spring. The pair of sliders 52 are supported by a pair of bars 53 so as to be movable in the main scanning direction. Each bar 53 extends in the main scanning direction and is set inside the corresponding slider 52.

The sub-wiping mechanism 50 also includes, as component members for a movement of the sub-wiper 51 in the main scanning direction, a pair of belts 54 each of which is fixed to the corresponding one of the pair of sliders 52 at a lower loop-shaped portions of each belt 54, pulleys 54*a*1, 54*a*2 on which the pair of belts 54 are respectively wound, a roller 54*b* on which the pair of belts 54 are respectively wound at opposite end portions of the roller 54*b* in the sub-scanning direction, and pulleys 54*b*1, 54*b*2 which are respectively attached to the opposite end portions of the roller 54 in the sub-scanning direction. Further, the sub-wiping mechanism 50 includes, as the component members for the movement of the sub-wiper 51, a gear 54*c* which is rotatable integrally with the pulley 54*b*2, and a gear 54*d* which meshes with the gear 54*c* and is fixed to an output shaft of a motor 59M. When the gears 54*c*, 54*d* are rotated by a drive of the motor 59M, the pulley 54*b*2 is rotated. The roller 54*b* is rotated with the rotation of the pulley 54*b*2, so that the pair of belts 54 are respectively circulated. With the circulation of the pair of belts 54, the pair of sliders 52 are moved in the main scanning direction while the wiper supporter 51*a* is supported by the pair of sliders 52.

Figure 6A:
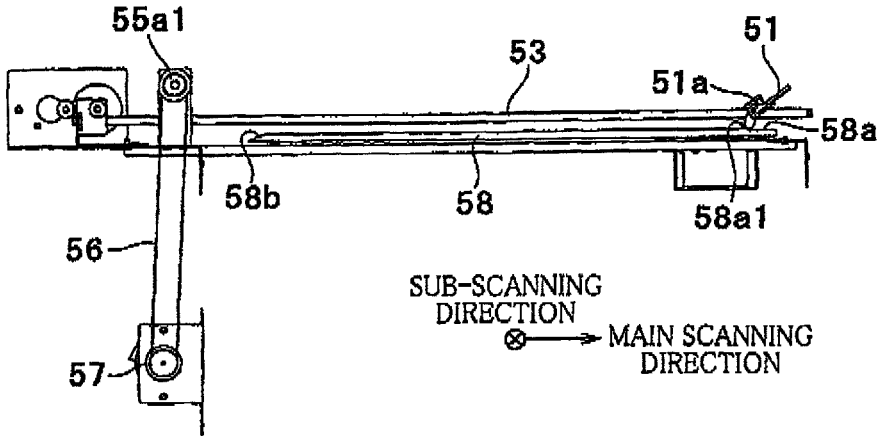
FIG. 6A through 6G are views for describing respective movements of a sub-wiper during a pre-cleaning operation.

The sub-wiping mechanism 50 further includes, as component members for a rotation of the sub-wiper 51, a plate 58 which is located below the wiper supporter 51*a*. The plate 58 is an elongated plate member which extends in the main scanning direction and is located in parallel with the horizontal surface. As shown in FIG. 6A, while the sub-wiper 51 is moved in the main scanning direction, a lower end of the wiper supporter 51*a* is slid on an upper surface of the plate 58.

The upper surface of the plate 58 is flat except opposite end portions of the plate 58 in the main scanning direction. A stepped surface 58*a* is formed on one end portion of the opposite end portions of the plate 58 in the main scanning direction, that is, an upstream, end portion in a direction of movement of the sub-wiper 51 during a removal of the foreign matters (in a direction indicated by an arrow in FIGS. 5 and 6A), and an inclined surface 58*b* on the other of the opposite end portions of the same 58 in the main scanning direction. The stepped surface 58*a* is located at a height level that is lower than that of a flat surface or a portion of the upper surface of the plate 58 except the stepped surface 58*a* and the inclined surface 58*b* formed on the opposite end portions of the plate 58 in the main scanning direction. There is formed a projecting portion 58*a*1 between the stepped surface 58*a* and the flat surface of the upper surface of the plate 58.

The sub-wiper cleaner 55*a* is used for cleaning of the sub-wiper 51 performed after the pre-cleaning operation is finished and is made of an absorber such as a sponge. The sub-wiper cleaner 55*a* has a cylindrical shape extending in the sub-scanning direction and is rotatably supported by a shaft 55*b*. The shaft 55*b* extends in the sub-scanning direction and is supported by the frame 62 so as to be rotatable with the sub-wiper cleaner 55*a* about an axis in the sub-scanning direction. The sub-wiping mechanism 50 also includes, as component members for a rotation of the shaft 55*b*, a pulley 57 which is fixed to an output shaft of a motor 51M, a pulley 55*a*1 which is fixed to one of opposite end portions of the shaft 55*b* in the sub-scanning direction, and a belt 56 which is wound on the pulleys 57, 55*a*1. When the pulley 57 is rotated with a drive of the motor 51M, the belt 56 is circulated, and the pulley 55*a*1 is rotated with the circulation of the belt 56, so that the shaft 55*b* is rotated with the sub-wiper cleaner 55*a* about the axis in the sub-scanning direction.

Hereinafter, movements of the sub-wiper 51 during the pre-cleaning operation will be described.

When the pre-cleaning operation is not performed, the sub-wiper 51 stands still at a home position which is located on the one of the opposite end portions of the plate 58 in the main scanning direction in a state in which the sub-wiper 51 is opposed to the surface 8*a* of the conveyor belt 8 in the vertical direction and inclined at an inclination angle θ1 relative to the horizontal surface such that an (free) end 51*b* (an example of an end portion of the sub-wiper) of the sub-wiper 51 is distant from the surface 8*a* of the conveyor belt 8. At this time, as shown in FIG. 6B, a lower end portion 51*a*1 of the wiper supporter 51*a* is in contact with one of inclined surfaces of the projecting portion 58*a*1 that is located nearer to the stepped surface 58*a*.

Figure 6B:
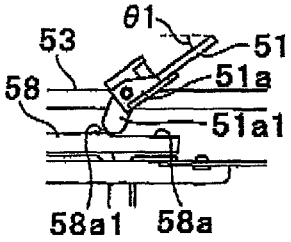
Figure 6C:
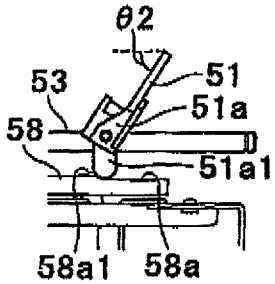
Figure 6D:
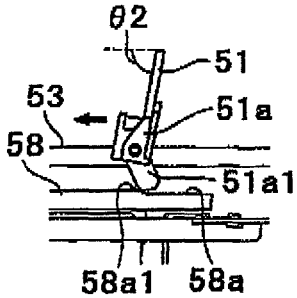
Figure 6E:
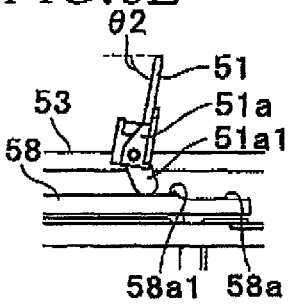
Figure 6F:
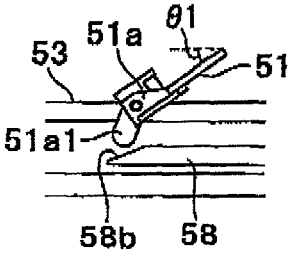

In the pre-cleaning operation, when the pair of sliders 52 start to be moved in the main scanning direction by the drive of the motor 59M, as shown in FIGS. 6B, 6C, 6D, the lower end portion 51*a*1 of the wiper supporter 51*a* is pivoted in a state of a contact with the inclined surface of the projecting portion 58*a*1. With the pivot of the wiper supporter 51*a*, the sub-wiper 51 is pivoted about an axis in the sub-scanning direction against a biasing force by the biasing member such that the inclination angle θ1 of the sub-wiper 51 relative to the horizontal surface is changed to the inclination angle θ2 thereof, leading to a contact of the end 51*b* of the sub-wiper 51 with the surface 8*a* of the conveyor belt 8. Then, as shown in FIG. 6E, the lower end portion 51*a*1 of the wiper supporter 51*a* climbs over the projecting portion 58*a*1, and the sub-wiper 51 is inclined at the inclination angle θ2. At this time, though the biasing force by the biasing member (a force acting in such a direction that the inclination angle θ2 of the sub-wiper 51 is changed to the inclination angle θ1) acts on the sub-wiper 51 and the wiper supporter 51*a*, the lower end portion 51*a*1 of the wiper supporter 51*a* is supported on the upper surface (the flat surface) of the plate 58, so that the sub-wiper 51 keeps at the inclination angle θ2. The sub-wiper 51 is then moved in the main scanning direction in a state in which the end 51*b* of the same 51 is in contact with the surface 8*a* of the conveyor belt 8. When the sub-wiper 51 reaches the other end portion of the plate 58 in the main scanning direction and the lower end portion 51*a*1 of the wiper supporter 51*a* reaches the inclined surface 58*b*, as shown in FIG. 6F, the lower end portion 51*a*1 thereof is moved away from the upper surface (the inclined surface 58*b*) of the plate 58. Therefore, by the biasing force of the biasing member, the sub-wiper 51 is pivoted about the axis in the sub-scanning direction with the wiper supporter 51*a* such that the inclination angle θ2 of the sub-wiper 51 is changed to the inclination angle θ1, so that the end 51*b* of the sub-wiper 51 is moved away from the surface 8*a* of the conveyor belt 8.

Figure 6G:
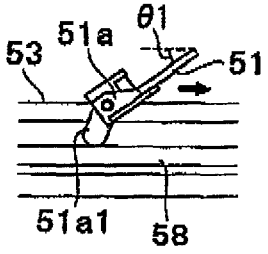

After the pre-cleaning operation is finished, as shown in FIG. 6G, in a state in which the sub-wiper 51 keeps at the inclination angle θ1 relative to the horizontal surface and the end 51*b* of the same 51 is distant from the surface 8*a* of the conveyor belt 8, the sub-wiper 51 is moved to a position at which the end 51*b* of the same 51 contacts the sub-wiper cleaner 55*a*. Then, after the end 51*b* of the sub-wiper 51 is cleaned, the sub-wiper 51 is moved in the main scanning direction toward the home position. After the lower end portion 51*a*1 of the wiper supporter 51*a* climbs over the other of the inclined surfaces of the projecting portion 58*a*1 that is located farther from the stepped surface 58*a* in the vicinity of the home position, in a state in which the sub-wiper 51 keeps at the inclination angle θ1 and the end 51*b* of the same 51 is distant from the surface 8*a* of the conveyor belt 8, the sub-wiper 51 is stopped at the home position.

The inclination angle θ2 is determined such that the end 51*b* of the sub-wiper 51 is in contact with the surface 8*a* of the conveyor belt 8 while the vicinity of the end 51*b* of the sub-wiper 51 is bent. Also, the component members (including the belt 54 and so on) for the movement of the sub-wiper 51 in the main scanning direction are located over the entire width of the conveyor belt 8. Therefore, in the pre-cleaning operation, the sub-wiper 51 is moved from one of the opposite sides of the conveyor belt 8 in the widthwise direction to the other thereof in a state in which the end 51*b* of the sub-wiper 51 is in contact with the surface 8*a* of the conveyor belt 8 while the vicinity of the end 51*b* of the sub-wiper 51 is bent, so that the sub-wiper 51 removes the foreign matters on the surface 8*a* of the conveyor belt 8 over the entire width thereof.

The foreign matters removed by the wipers 41, 51 axe received by corresponding trays (not shown) located below the respective wipers 41, 51.

Hereinafter, an electric structure of the inkjet printer 1 will be described with reference to FIG. 7.

Figure 7:
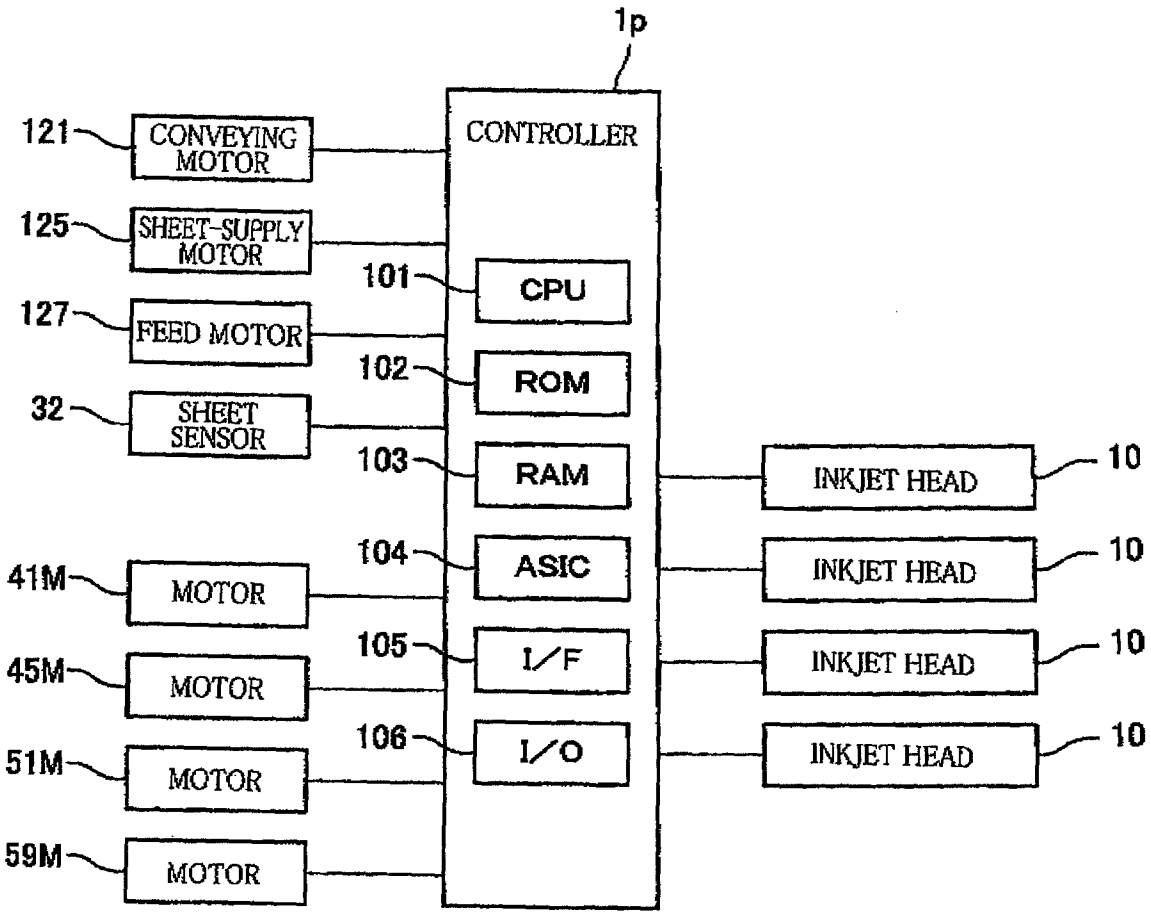
FIG. 7 is a block diagram showing an electric structure of the printer.

The controller 1*p* includes, as shown in FIG. 7, in addition to a CPU (Central Processing Unit) 101 as an arithmetic processing unit, a ROM (Read Only Memory) 102, a RAM (Random Access Memory: including a nonvolatile RAM) 103, an AMC (Application Specific Integrated Circuit) 104, an I/F (Interface) 105, an I/O (Input/Output Port) 106 and so forth. In the ROM 102, programs that are executed by the CPU 101, various fixed data and so on are stored. In the RAM 103, data that are necessary when executing the programs (for example, image data concerning an image that is recorded on the recording sheet P) are temporarily stored. In the ASIC 104, a rewriting of data, a sorting or rearranging of data (for example, a signal processing and an image processing) and so on are performed. The I/F 105 transmits data to or receives data from the external device. The I/O 106 inputs/outputs detection signals from various sorts of sensors.

The controller 1*p* is connected to the respective motors 121, 125, 127, 41M, 45M, 51M, 59M, the sheet sensor 32, the respective control boards of the four inkjet heads 10, and so forth.

Hereinafter, the content of the maintenance operation executed by the controller 1*p* will be described with reference to FIG. 8. The following steps are executed by the CPU 101 based on the program stored in the ROM 102.

Figure 8:
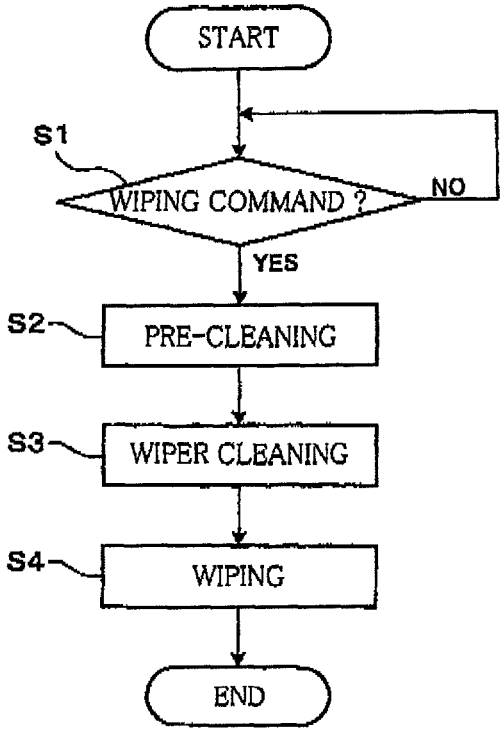
FIG. 8 is a flow chart illustrating a content of a maintenance operation that is executed by a controller of the printer.

The controller 11*p*, as shown in FIG. 8, first determines whether the wiping command is received (step S1). The wiping command is received, for example, after a power source is turned on, after a purging operation (an operation in which a pump is driven to apply a pressure to inks in the heads 10 such that the inks are ejected from all the nozzles 14*a*) and a preliminary ejection (an operation in which the actuators of the heads 10 are driven based on preliminary ejection data that are different from the image data such that inks are ejected from the nozzles 14*a*) are performed, when a jamming of the recording sheet P occurs, when the recording operation has been performed on a predetermined number of the recording sheets P since a start of the recording operation by the printer 1 based on the recording command, when a predetermined period of time has passed since the start of the recording operation by the printer 1 based on the recording command, and so on.

In a case where it is determined that the wiping command is not received (S1: NO), the controller 11*p* keeps in a standby state (condition). In a case where it is determined that the wiping command is received (S1: YES), the controller 1*p* controls the drives of the conveying unit 21 and the maintenance unit 60 such that a series of operations (the maintenance operation) including the pre-cleaning operation (82), the wiper cleaning operation (83), and the wiping operation (84) are performed.

In the pre-cleaning operation, the controller 1*p*, in a state in which the conveyor belt 8 is stopped, drives the motor 59M in a forward direction. Accordingly, as described before, the end 51*b* of the sub-wiper 51 distant from the surface 8*a* of the conveyor belt 8 contacts the surface 8*a* of the same 8, and the sub-wiper 51 is moved from the home position in the main scanning direction, so that the foreign matters on the surface 8*a* of the conveyor belt 8 are removed. The controller 1*p* then stops the drive of the motor 59 M once at a timing when the sub-wiper 51 has reached the other of the opposite end portions of the plate 58 in the main scanning direction. At this time, the end 51*b* of the sub-wiper 51 is distant from the surface 8*a* of the conveyor belt 8 (shown in FIG. 6F) and is in contact with the sub-wiper cleaner 55*a*. Then, the controller 1*p* drives the motor 59M in a backward direction so as to move the sub-wiper 51 in the opposite direction in the main scanning direction, as shown in FIG. 6G, (in the opposite direction to the direction of the movement of the sub-wiper 51 during the removal of the foreign matters, or the direction indicated by the arrow in FIGS. 5 and 6A), and stops the drive of the motor 59M at a timing when the sub-wiper 51 has reached the home position.

A portion of the surface 8*a* of the conveyor belt 8 on which the foreign matters are removed by the sub-wiper 51 in the pre-cleaning operation (S2) becomes a clean area (as example of a clean area) on which an amount of the foreign matters adhering to the surface 8*a* is smaller than that on the other area of the surface 8*a* except the clean area. That is, all area of the surface 8*a* of the conveyor belt 8 on which the end 51*b* of the sub-wiper 51 contacts in the pre-cleaning operation (82) becomes the clean area. During the pre-cleaning operation (82), the controller 1*p* maintains a stop of other movements except movements related to the pre-cleaning operation (82).

In the wiper cleaning operation (S3), the controller 1*p*, in the state in which the conveyor belt 8 is stopped, drives the motor 41M so as to rotate the main wiper 41 once in a clockwise direction in FIG. 1 about the axis in the main scanning direction. During this rotation, the end 41*a* of the main wiper 41 contacts the circumferential surface of the wiper cleaner 45 with being bent. At this time, the foreign matters adhering to the end 41*a* of the main wiper 41 are adhering to the wiper cleaner 45 and removed from the end 41*a* of the same 41.

The timing of the wiper cleaning operation (S3) completely overlaps with the timing of the pre-cleaning operation (S2). In the present embodiment, the controller 1*p* starts the drive of the motor 41M in the wiper cleaning operation (S3) generally at the same time as starting of the drive of the motor 59M in the forward direction in the pre-cleaning operation (82). It is not indispensable that the wiper cleaning operation (83) completely overlaps in terms of time with the pre-cleaning operation (82). For example, a period of time when the pre-cleaning operation (S2) is performed may partly overlap with a period of time when the wiper cleaning operation (83) is performed.

In the wiping operation (84), the controller 1*p* drives the conveying motor 121 so as to circulate the conveyor belt 8 and stops the drive of the conveying motor 121 at a timing at which the clean area of the conveyor belt 8 is positioned above the end 41*a* of the main wiper 41. In other words, the controller 1*p* stops the drive of the conveying motor 121 at a timing at which the clean area is positioned at the vicinity of the end 41*a* of the main wiper 41. Here, that the clean area is positioned at the vicinity of the end 41*a* of the main wiper 41 means that the clean area is positioned at such a position that, with the rotation of the main wiper 41 about the axis in the main scanning direction, the end 41*a* of the main wiper 41 contacts a portion inside the clean area of the conveyor belt 8. The controller 1*p* then drives the motor 41M to rotate the main wiper 41 by a slight angle about the axis in the main scanning direction such that the end 41*a* of the main wiper 41 which was distant from the surface 8*a* of the conveyor belt 8 contacts the surface 8*a* thereof. The controller 1*p* stops the drive of the motor 41M at a timing at which the end 41*a* of the main wiper 41 is in contact with the surface 8*a* of the conveyor belt 8 with the end 41*a* of the same 41 being bent. Then, the controller 1*p* drives the conveying motor 121 again such that the conveyor belt 8 makes one or a few rounds. Thus, the foreign matters are removed from the surface 8*a* of the conveyor belt 8. The controller 1*p* stops the drive of the conveying motor 121 after the conveyor belt 8 makes one or a few rounds. Then, In a state in which the conveyor belt 8 is stopped, the controller 1*p* drives the motor 41M to rotate the main wiper 41 by the slight angle about the axis in the main scanning direction such that the end 41*a* of the main wiper 41 is moved away from the surface 8*a* of the conveyor belt 8.

The wiping operation (S4) is performed after the pre-cleaning operation (S2) and the wiper cleaning operation (S3) are finished.

The controller 1*p* rotates the wiper cleaner 45 by a predetermined angle that is smaller than 360 degrees every time when one time or a few times of the wiper cleaning operation (S3) are finished. Therefore, a portion of the wiper cleaner 45 which the end 41*a* of the main wiper 41 contacts during the wiper cleaning operation is always changed, so that the foreign matters adhering to the end 41*a* of the main wiper 41 can be effectively removed.

As mentioned above, in the printer 1, the controller 1*p* and the program in the present embodiment, when the wiping operation is performed, the end 41*a* of the main wiper 41 is in contact with the clean area that is the portion of the surface 8*a* of the conveyor belt 8, so that the foreign matters hardly exist between the end 41*a* of the main wiper 41 and the surface 8*a* of the conveyor belt 8. Accordingly, a decrease of a wiping performance, caused by a gap made by the foreign matters existing between the end 41*a* of the main wiper 41 and the surface 8*a* of the conveyor belt 8, is effectively restrained.

Since the clean area is formed on the surface 8*a* of conveyor belt 8 in the pre-cleaning operation (82), the amount of the foreign matters adhering to the clean area can be more certainly reduced. Therefore, the decrease of the wiping performance caused by the above-mentioned phenomenon can be more certainly restrained. Further, the sub-wiper 51 for the pre-cleaning operation is cleaned by the sub-wiper cleaner 55*a*, so that the amount of the foreign matters adhering to the clean area can be reduced much more certainly.

Since the foreign matters adhering to the end 41*a* of the main wiper 41 are removed in the wiper cleaning operation (S3) performed before the wiping operation, the decrease of the wiping performance can be restrained much more certainly.

The pre-cleaning operation (S2) and the wiper cleaning operation (S3) are performed with overlapping each other in terms of time. Therefore, the pre-cleaning operation and the wiper cleaning operation can restrain the decrease of the wiping performance in a short time and efficiently.

During the pre-cleaning operation (S2), the controller 1*p* maintains the stop of the other movements except the movements related to the pre-cleaning operation, for example, a drive of a fan for an ink mist suction. If the other movements occur during the pre-cleaning operation, the foreign matters such as the paper dust are whirled up in the air and may be adhered to the clean area made in the pre-cleaning operation. In the present embodiment, the above-mentioned problem can be reduced.

The controller 1*p* keeps in the state in which the end 41*a* of the main wiper 41 is distant from the surface 8*a* of the conveyor belt 8 while the image is recorded on the recording sheet P by the inkjet heads 10 based on the image data, for example, when a NO decision is made in step S1. If the wiping operation (S4) is performed during the recording operation, a load affects on the conveyor belt 8 caused by a contact of the main wiper 41 with the conveyor belt 8, leading to a deterioration in a conveying accuracy. In the present embodiment, because the wiping operation (S4) is not performed during the recording operation, a high conveying accuracy can be secured. The controller 1*p* includes a wiping operation executing portion, a pre-cleaning operation executing portion, a wiper cleaning operation, an operation stopping portion, a distant portion in the present invention.

Hereinafter, a second embodiment to which the present invention is applied will be described.

The second embodiment is different from the first embodiment in that the wiper cleaning operation (S3) is performed by the sub-wiper 51 instead of the wiper cleaner 45, and the other components in the second embodiment are the same as those in the first embodiment. More specifically described, in the second embodiment, the maintenance unit 60 does not include the wiper cleaner 45, and the main wiper 41 is located such that the end 41*a* of the same 41 can contact and be distanced from one of opposite end surfaces of the sub-wiper 51 in the sub-scanning direction. In the pre-cleaning operation (S2), the controller 1*p* first drives the motor 41M to rotate the main wiper 41 by a slight angle about the axis in the main scanning direction such that the end 41*a* of the main wiper 41 contacts the one end surface of the sub-wiper 51. The controller 1*p* keeps the main wiper 41 in this state and drives the motor 59M so as to move the sub-wiper 51 in the main scanning direction. The foreign matters adhering to the end 41*a* of the main wiper 41 are thus scraped off by the one end surface of the sub-wiper 51 and removed from the end 41*a* of the same 41. Though FIG. 5 is appropriated for a description of the second embodiment, the maintenance unit 60 includes no wiper cleaner 45 in the second embodiment, so that it is considered in the second embodiment that the wiper cleaner 45 and the components related to the wiper cleaner 45 (the motor 45M, the shaft 46, the pulley 46*p*, the pulley 47 and the belt 48) are omitted from FIG. 5. Further, it is considered that, in order that the end 41*a* of the main wiper 41 is contactable with the one end surface of the sub-wiper 51, a distance between the main wiper 41 and the sub-wiper 51 in the sub-scanning direction is smaller than that in the first embodiment.

In the second embodiment, since the sub-wiper 51 used for the pre-cleaning operation (S2) is applied to the wiper cleaning operation (S3), the wiper cleaner 45 can be omitted, so that a simplified structure of the painter 1 can be realized. Also, the pre-cleaning operation (S2) and the wiper cleaning operation (S3) can be simultaneously performed so as to increase an efficiency of operations.

Hereinafter, a third embodiment to which the present invention is applied will be described.

The printer 1 in the third embodiment is different from that in the first embodiment in that the pre-cleaning operation (S2) is performed by the main wiper 41 instead of the sub-wiper 51, and the other components in the third embodiment are the same as those in the first embodiment. More specifically, in the third embodiment, the maintenance unit 60 does not include the sub-wiper 51. In the pre-cleaning operation (S2), the controller 1*p* first drives the motor 41M in a state in which the conveyor belt 8 is stopped such that the end 41*a* of the main wiper 41 which was distant from the surface 8*a* of the conveyor belt 8 contacts the surface 8*a* thereof. The controller 1*p* then drives the conveying motor 121 in a forward direction such that the conveyor belt 8 is circulated by a predetermined distance, for example, a distance that is substantially equal to a width (or a dimension measured in the main scanning direction) of the main wiper 41). By this, the foreign matters on the surface 8*a* of the conveyor belt 8 are removed and the clean area is made on the surface 8*a*. Then, the controller 1*p* drives the motor 41M to rotate by the slight angle about the axis in the main scanning direction such that the end 41*a* of the main wiper 41 is moved away from the surface 8*a* of the conveyor belt 8. After this, the controller 1*p* drives the conveying motor 121 in a backward direction opposite to the forward direction such that the conveyor belt 8 is circulated in the opposite direction to the conveying direction by a slight distance, and stops the drive of the conveying motor 121 at a timing at which the clean area is positioned above the end 41*a* of the main wiper 41. Then, the controller 1*p* drives the motor 41M again such that the end 41*a* of the main wiper 41 distant from the surface 8*a* of the conveyor belt 8 contacts the surface 8*a* thereof. The controller 1*p* then drives the conveying motor 121, similarly to the first embodiment, such that the conveyor belt 8 makes one or a few rounds. Though FIG. 5 is appropriated for a description of the third embodiment, the maintenance unit 60 in the third embodiment includes no sub-wiper 51, so that it is considered in the third embodiment that the sub-wiper 51 and the components related to the sub-wiper 51 (the wiper supporter 51*a*, the pair of sliders 52, the pair of bars 53, the pair of belts 54, the pulleys 54*a*1, 54*a*2, the roller 54*b*, the pulleys 54*b*1, 54*b*2, the gears 54*c*, 54*d*, the sub-wiper cleaner 55*a*, the shaft 55*b*, the belt 56, the pulley 57, the plate 58, the stepped surface 58*a*, and the inclined surface 58*b*) are omitted from FIG. 5.

In the third embodiment, since the main wiper 41 used for the wiping operation (S4) is applied to the pre-cleaning operation (S2), the sub-wiper 51 can be omitted, so that a simplified structure of the printer 1 can be realized.

The present invention is not limited to the illustrated embodiments. It is to be understood that the present invention may be embodied with various changes and modifications that may occur to a person skilled in the art, without departing from the spirit and scope of the invention defined in the appended claims.

The main wiper 41 may extend in an oblique direction relative to the main scanning direction. Also, the sub-wiper 51 may extend in an oblique direction relative to the sub-scanning direction.

In a wiping operation and a pre-cleaning operation, directions of movement of a wiper and a cleaner relative to a surface of a conveying member is not limited to a particular one. As the directions of the relative movement of the wiper and the cleaner, various directions may be adopted, such as the conveying direction, the direction perpendicular to the conveying direction, an oblique direction relative to the conveying direction and the direction perpendicular to the conveying direction, and so on.

It is not limited that, in the wiping operation, the surface of the conveying member is moved while the wiper is at a standstill state. The wiper may be moved while the surface of the conveying member is at the standstill state.

It is not limited that, in the pre-cleaning operation, the wiper or the cleaner is moved while the conveying member is at the standstill state. The surface of the conveying member may be moved while the wiper or the cleaner is at the standstill state.

In the wiping operation in the illustrated embodiments, the conveyor belt 8 is circulated by one or a few rounds while the end 41*a* of the main wiper 41 is in contact with the surface 8*a* of the conveyor belt 8. It is not limited that the conveyor belt 8 makes one round or more, and the conveyor belt 8 may be circulated such that the end 41*a* of the main wiper 41 reaches at least outside the clean area.

The conveying member is not limited to the conveyor belt, for example, may be a rotary drum and so forth.

The wiper may have various shape, not limited to be a plate, as long as foreign matters on the surface of the conveying member can be removed by a movement of the wiper relative to the surface of the conveying member while the end of the wiper is in contact with the surface of the conveying member.

The cleaner used for the pre-cleaning operation is not limited to the plate member made of the elastic material such as the sub-wiper 51 in the first embodiment. As long as the cleaner can remove the foreign matters on the surface of the conveying member, the cleaner may be for example, a member including a brush and the like which removes the foreign matters by an electrostatic force, an air suction member, an air discharge member, a roller whose circumferential surface has a viscosity, and so on. In a case where the cleaner consists of the member which removes the foreign matters by the electrostatic force, the air suction member, the air discharge member, or the like, it is not required that the cleaner is in contact with the surface of the conveying member in the pre-cleaning operation.

A member used for the wiper cleaning operation is not limited to be an absorbing member such as the wiper cleaner 45 in the first embodiment. As long as the member for the wiper cleaning operation can remove the foreign matters adhering to the end portion of the wiper, the member may be, for example, a member including a brush and the like which removes the foreign matters by the electrostatic force, the air suction member, the air discharge member, the roller whose circumferential surface has a viscosity, and so on. In a case where the member for the wiper cleaning operation consists of the member which removes the foreign matters by the electrostatic force, the air suction member, the air discharge member, or the like, it is not required that the member is in contact with the end portion of the wiper in the wiper cleaning operation. The sub-wiper 51 in the first and the second embodiments performs the wiping operation by the movement of the same 51 in the main scanning direction with a contact of the same 51 with the surface 8*a* of the conveyor belt 8. However, the present invention is not limited to this configuration. For example, the sub-wiper 51 may extend in the main scanning direction, that is, have the same shape as the main wiper 41, and may be located at a position in parallel with the main wiper 41. In the pre-cleaning operation (S2), the conveyor belt 8 may be circulated while the above-mentioned sub-wiper 51 is in contact with the surface 8*a* of the conveyor belt 8 so as to make the clean area. In this configuration, a mechanism for the movement of the sub-wiper 51 in the main scanning direction is unnecessary, so that the sub-wiper 51 and component portions of the same 51 can be realized in a compact manner.

The foreign matters which are removed in the wiping operation, the pre-cleaning operation, and the wiper cleaning operation are, for example, ink, toner, paper dust and so forth.

The clean area may consist of; in addition to the clean area produced in the pre-cleaning operation, a non-supporting area (an area on the surface of the conveying member except a supporting area on which a recoding medium is supported), a conductive area (an area having a conductivity because the surface of the conveying member is covered with a conductive coating, and so on), a liquid-repellent area, that is, an area having a liquid-repellency so as to repel liquid for a recording operation (for example, ink in a case of an inkjet printer) because a liquid-repellent treatment is performed on the surface of the conveying member, and so forth.

The pre-cleaning operation and the wiper cleaning operation may not temporally overlap with each, other.

The wiper cleaning operation may not be performed before the pre-cleaning operation.

The wiping operation may be performed at any timing, in addition to the timing illustrated in the illustrated embodiments (after the power source of the printer 1 is turned on and so forth). For example, in a case where, during a concurrent recording operation in which a recording operation is concurrently performed on two or more recording media, a preliminary ejection is performed on a preliminary ejection area of the surface of the conveying member which is located between supporting areas on which the recording media are supported, the wiping operation may be performed while the end portion of the wiper is in contact with the surface of the conveying member during the concurrent recording operation.

During the pre-cleaning operation, other movements except movements related to the pre-cleaning operation may be performed.

The present invention is applicable to either one of a line-type printer and a serial-type printer. The present invention is, not limited to a printer, applicable to a facsimile machine, a copier machine, and so forth, and also applicable to a recording device which performs a recording operation by ejecting liquid except ink. The present invention is not limited to an inkjet recording device, and is applicable to, for example, a laser-type recording device, a thermal-type recording device and so on.

The recording media are not limited to the recording sheets P, and may be various recordable media.

What is claimed is:

1. An image recording apparatus comprising:

a recording portion configured to record an image on a recording medium;

a conveying member which has a surface opposed to the recording portion and which is configured to convey the recording medium in a conveying direction by a movement of the surface of the conveying member in the conveying direction with the recording medium supported by the surface thereof;

a wiper which has an end portion contactable with the surface of the conveying member and which is configured to remove a foreign matter on the surface of the conveying member by a relative movement of the wiper to the surface of the conveying member with the end portion of the wiper and the surface of the conveying member in contact with each other;

a wiping operation executing portion configured to execute a wiping operation in which at least one of the wiper and the conveying member is driven such that, after the end portion of the wiper distant from the surface of the conveying member comes into contact with a clean area, the end portion of the wiper reaches outside of the clean area, wherein the clean area is a part of the surface of the conveying member and has a smaller amount of the foreign matter adhering thereto compared to the other part of the surface, a pre-cleaning operation executing portion configured to execute a pre-cleaning operation, before the wiping operation is executed, in which the clean area is produced by performing of a pre-cleaning in which the foreign matter on the surface of the conveying member is removed by a cleaner, which is different from the wiper, wherein the cleaner includes a sub-wiper having an end portion contactable with the surface of the conveying member, and wherein the pre-cleaning operation executing portion is configured to move the end portion of the sub-wiper relative to the surface of the conveying member in a direction intersecting with the conveying direction in a state in which the end portion of the sub-wiper is in contact with the surface of the conveying member.

2. The image recording apparatus according to claim 1, wherein the clean area is a whole area of the surface of the conveying member with which the end portion of the sub-wiper is held in contact during the pre-cleaning operation.

3. The image recording apparatus according to claim 1, wherein the wiping operation executing portion is configured to move the conveying member such that the clean area is positioned at the vicinity of the end portion of the wiper before the end portion thereof contacts the clean area.

4. The image recording apparatus according to claim 1, further comprising a wiper cleaning operation executing portion which is configured to execute a wiper cleaning operation, before the wiping operation is executed, in which a wiper cleaning is operated such that the foreign matter adhering to the end portion of the wiper is removed.

5. The image recording apparatus according to claim 4, further comprising a wiper cleaner which extends in a direction in which the wiper extends and which is contactable with the end portion of the wiper throughout an entire length of the wiper in the direction in which the wiper extends, wherein the wiper extends in such a way that a length thereof in a direction perpendicular to the conveying direction is longer than that of the surface of the conveying member in the direction perpendicular to the conveying direction and is positioned at a position at which the wiper is contactable with the conveying member throughout an entire length of the surface of the conveying member in the direction perpendicular to the conveying direction, wherein the wiper cleaning operation is executed such that the foreign matter adhering to the end portion of the wiper is removed by a movement of the end portion thereof relative to the wiper cleaner.

6. The image recording apparatus according to claim 1, further comprising a wiper cleaning operation executing portion configured to execute a wiper cleaning operation, before the wiping operation is executed, in which the foreign matter adhering to the end portion of the wiper is removed, and wherein the pre-cleaning operation and the wiper cleaning operation are overlapped in terms of time.

7. The image recording apparatus according to claim 1, further comprising an operation stopping portion configured to maintain a state in which other operations except the pre-cleaning operation are stopped during the pre-cleaning operation.

8. The image recording apparatus according to claim 1, further comprising a distant portion configured to maintain a state in which the end portion of the wiper is distant from the surface of the conveying member while an image is recorded on the recording medium by the recording portion based on image data.

9. An image recording apparatus comprising:

a recording portion configured to record an image on a recording medium;

a conveying member which has a surface opposed to the recording portion and which is configured to convey the recording medium in a conveying direction by a movement of the surface of the conveying member in the conveying direction with the recording medium supported by the surface thereof;

a wiper which has an end portion contactable with the surface of the conveying member and which is configured to remove a foreign matter on the surface of the conveying member by a relative movement of the wiper to the surface of the conveying member with the end portion of the wiper and the surface of the conveying member in contact with each other;

a changing mechanism configured to change a state of the wiper between a first state in which the end portion of the wiper is in contact with the surface of the conveying member and a second state in which the end portion of the wiper is distant from the surface of the conveying member, a wiping operation executing portion configured to execute a wiping operation in which at least one of the wiper and the conveying member is driven such that, after the end portion of the wiper distant from the surface of the conveying member comes into contact with a clean area, the end portion of the wiper reaches outside of the clean area, wherein the clean area is a part of the surface of the conveying member and has a smaller amount of the foreign matter adhering thereto compared to the other part of the surface, and a pre-cleaning operation executing portion configured to execute a pre-cleaning operation, before the wiping operation is executed, in which the clean area is produced by performing of a pre-cleaning in which the foreign matter on the surface of the conveying member is removed, wherein the pre-cleaning operation executing portion is configured to move the end portion of the wiper relative to the surface of the conveying member to produce the clean area when the state of the wiper is in the first state in which the end portion of the wiper and the surface of the conveying member are in contact with each other, wherein pre-cleaning operation execution portion is configured to control the changing mechanism, after the clean area has been produced, to change the state of the wiper from the first state to the second state in which the end portion of the wiper is distant from the surface of the conveying member, wherein the wiping operation executing portion is configured to move the end portion of the wiper relative to the surface of the conveying member and configured to control the changing mechanism to change the state of the wiper from the second state to the first state such that the end portion of the wiper is in contact with the clean area in the surface of the conveying member.

10. The image recording apparatus according to claim 9, further comprising a wiper cleaning operation executing portion configured to execute a wiper cleaning operation, which is executed after the pre-cleaning operation and before the wiping operation, in which the wiper used in the pre-cleaning operation is cleaned such that the foreign matter adhering to the end portion of the wiper is removed.

* * * * *